United States Patent [19]

Lane et al.

[11] Patent Number: 4,858,406

[45] Date of Patent: Aug. 22, 1989

[54] COPING STRUCTURE INCLUDING RIGID ANCHOR BAR

[75] Inventors: Bennie L. Lane, Eagle; William T. Taylor, Whitefish Bay, both of Wis.

[73] Assignee: Metal Era, Inc., Waukesha, Wis.

[21] Appl. No.: 217,969

[22] Filed: Jul. 12, 1988

[51] Int. Cl.[4] ..... E04F 19/02

[52] U.S. Cl. ..... 52/300; 52/58

[58] Field of Search ..... 52/300, 58–62, 52/94–96

[56] References Cited

U.S. PATENT DOCUMENTS

| | | | |
|---|---|---|---|
| Re. 28,870 | 1/1976 | Attaway et al. | 52/300 |
| 2,959,259 | 11/1960 | Meyer | 189/88 |
| 3,270,474 | 9/1966 | Driggers | 52/395 |
| 3,404,495 | 10/1968 | Simpson, Jr. | 52/58 |
| 3,405,485 | 10/1968 | Edwards | 52/60 |
| 3,507,470 | 4/1970 | Gobel | 248/205 |
| 3,512,326 | 5/1970 | Greene | 52/588 |
| 3,680,269 | 8/1972 | Fischer, Jr. et al. | 52/94 |
| 3,802,140 | 4/1974 | Hickman | 52/300 |
| 3,862,531 | 1/1975 | Attaway et al. | 52/58 |
| 4,083,158 | 4/1978 | Wolma | 52/300 |
| 4,419,850 | 12/1983 | Butzen | 52/60 |
| 4,665,667 | 5/1987 | Taylor et al. | 52/96 |
| 4,709,518 | 12/1987 | Lane | 52/94 |

*Primary Examiner*—James L. Ridgill, Jr.

*Attorney, Agent, or Firm*—Michael, Best & Friedrich

[57] ABSTRACT

A coping assembly including an anchor bar adapted to be secured to a forward face of a wall, the anchor bar being an elongated plate adapted to extend along the length of the forward face of the wall, and a coping having an inverted channel configuration and including a top portion adapted to cover the top surface of the wall, the forward face of the coping including a lower edge portion engaging the elongated lower edge of the anchor bar, and a forward portion of the top of the coping being supported by the elongated upper edge of the anchor bar. The coping assembly also includes support cleats adapted to be secured by fasteners to the top of the wall, the support cleats including a generally horizontal portion adapted to be supported by the top of the wall, an upwardly inclined forward portion extending upwardly and forwardly and engaging a flange of the anchor bar.

9 Claims, 2 Drawing Sheets

COPING STRUCTURE INCLUDING RIGID ANCHOR BAR

FIELD OF THE INVENTION

The invention relates to coping structures for buildings and more particularly to sheet metal copings and structures for supporting sheet metal copings such that the copings are firmly secured in place on the top of a wall of a roof.

BACKGROUND PRIOR ART

Coping structures are commonly used in capping walls or parapets extending above the level of a roof and functioning as a water barrier to prevent seepage of water into the wall and also functioning as a decorative cover to enhance the appearance of a building. Prior art coping structures are shown in the Wolma U.S. Pat. No. 4,083,158, issued Apr. 11, 1978; the Attaway et al. U.S. Pat. No. Re.23,870, reissued June 22, 1976; and the Hickman U.S. Pat. No. 3,802,140, issued Apr. 9, 1974.

Attention is also directed to the Fischer, Jr. et al. U.S. Pat. No. 3,680,269, issued Aug. 1, 1972; the Gobel U.S. Pat. No. 3,507,470, issued Apr. 21, 1970; the Simpson, Jr. U.S. Pat. No. 3,404,495, issued Oct. 8, 1968; the Edwards U.S. Pat. No. 3,405,485, issued Oct. 15, 1968; the Greene U.S. Pat. No. 3,512,326, issued May 19, 1970; the Driggers U.S. Pat. No. 3,270,474, issued Sept. 6, 1966; and the Meyer U.S. Pat. No. 2,959,259, issued Nov. 8, 1960.

Attention is further directed to the Butzen U.S. Pat. No. 4,419,850, issued Dec. 13, 1983; the Lane U.S. Pat. No. 4,709,518, issued Dec. 1, 1987; and the Taylor et al. U.S. Pat. No. 4,665,667, issued May 19, 1987.

Attention is also directed to applicant's copending U.S. Pat. application Ser. No. 046,573, and titled Fascia Including Means for Rigidly Securing A Membrane In Place.

SUMMARY OF THE INVENTION

The invention provides an improved coping assembly and particularly an improved means for securing a coping to the top of a wall such that it can withstand even high winds and also providing an improved means for supporting the coping along its entire length at the face of the wall. The coping assembly embodying the invention also accommodates walls of inconsistent thickness along their length and walls wherein the faces of the wall are not at right angles to the top of the wall, while also providing a coping assembly which produces a uniform and attractive configuration at the face of the wall.

More specifically, the invention includes a coping assembly including an anchor bar adapted to be secured to the forward face of a wall, the anchor bar including an elongated plate adapted to extend along the length of the forward face of the wall, and a coping having an inverted channel configuration and including a top portion adapted to cover the top surface of the wall, a forward face extending downwardly from the top portion, and a rearward face extending downwardly from the top portion. The forward face of the coping includes a lower edge portion engaging the elongated lower edge of the anchor bar, and a forward portion of the top of the coping is supported by the elongated upper edge of the anchor bar.

One of the features of the invention is the further provision of at least one coping support cleat adapted to be secured by a fastener to the top of the wall, the coping support cleat including a generally horizontal portion adapted to be supported by the top of the wall, the horizontal portion including a forward edge, an upwardly inclined forward portion extending upwardly and forwardly and terminating in an edge, and a downwardly extending rear wall portion extending downwardly from the horizontal portion and adapted to be positioned in facing relation with the rear face of the wall.

In one embodiment of the invention the rearward face of the coping includes a lower edge having means for engaging the lower edge of the rear wall portion of the cleat.

In one embodiment of the invention the the lower edge of the rearward face of the coping includes a lip adapted to extend under the lower edge of the rear wall portion of the cleat to grip the cleat.

In one embodiment of the invention the upper portion of the anchor bar includes a rearwardly projecting lip adapted to house the edge of the upwardly inclined forward portion of the cleat.

In one embodiment of the invention the cleat further includes spring means for resiliently biasing the rearward portion of the coping upwardly such that the lower edge of the rear face of the coping will engage and grip the lower edge of the rear wall of the cleat.

Various other features and advantages of the invention will be apparent by reference to the following description of a preferred embodiment, from the drawings and from the claims.

Figure 1:
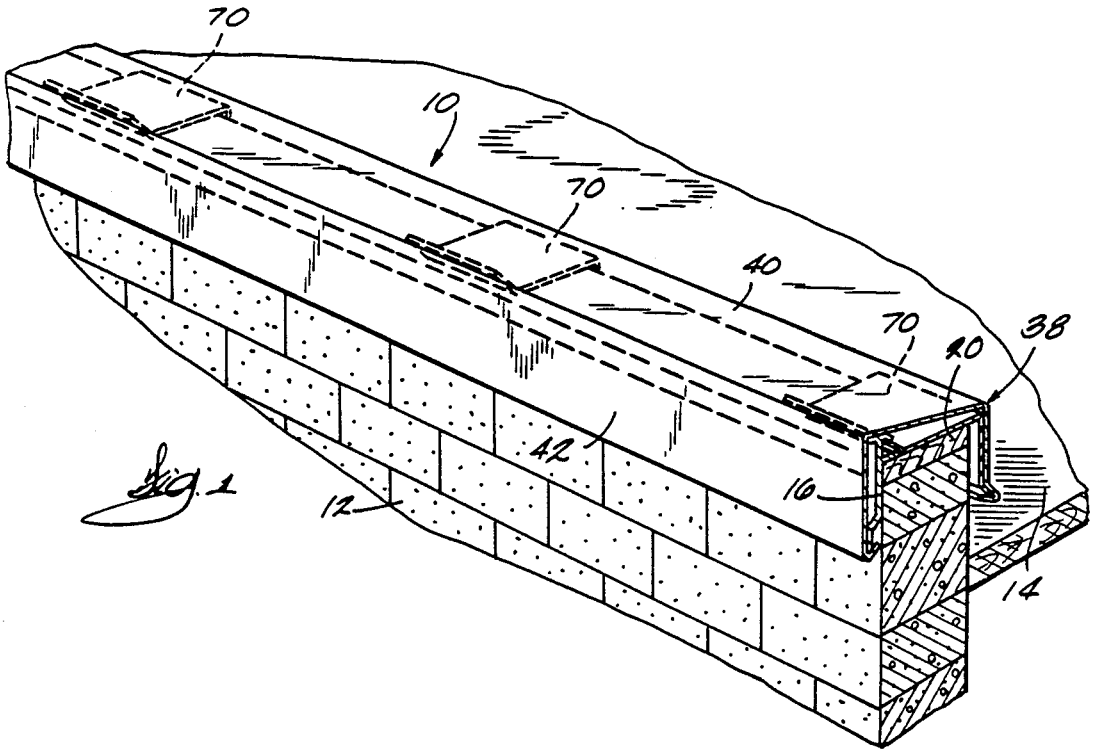
FIG. 1 is a perspective view of a wall supporting a coping assembly embodying the invention.
Figure 2:
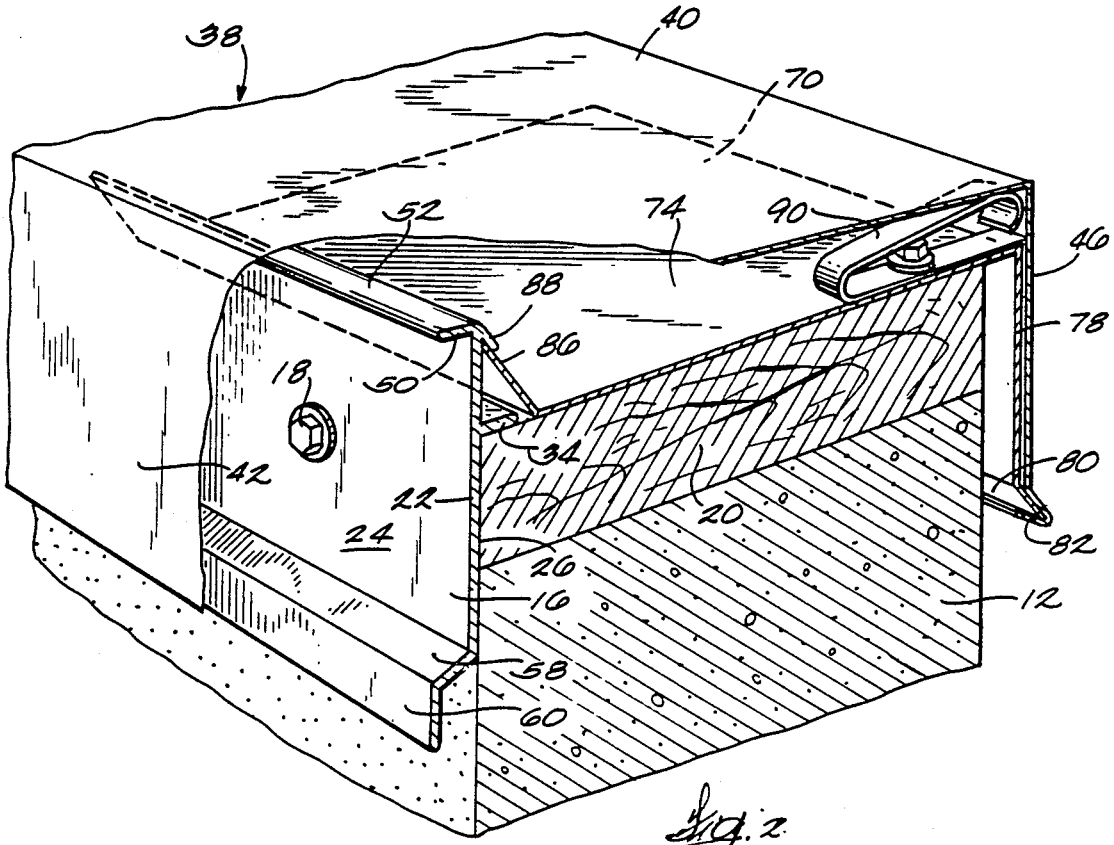
FIG. 2 is an enlarged perspective view of a portion of the coping assembly shown in FIG. 1 and with portions cut away.
Figure 3:
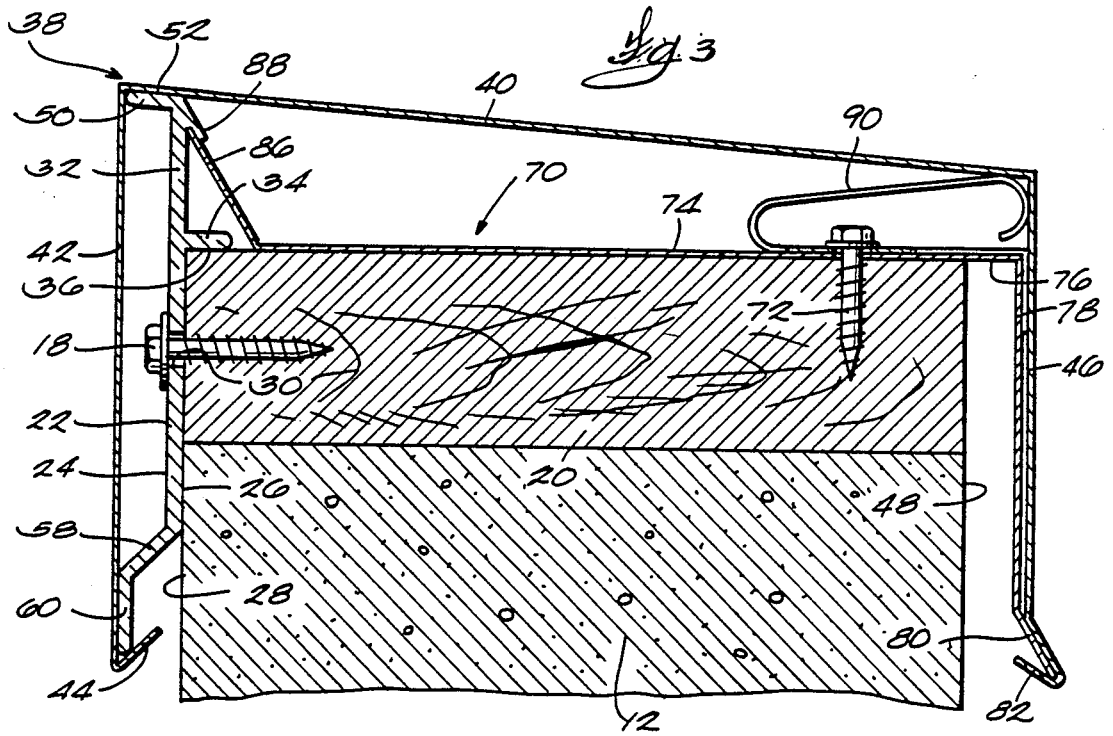
FIG. 3 is a cross section view of the coping assembly shown in FIGS. 1 and 2.

Before describing one embodiment of the invention in detail, it is to be understood that the invention is not limited in its application to the details of construction and to the arrangement of components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a coping assembly 10 embodying the invention and mounted on the top of a wall 12 extending upwardly from the roof 14 of a building. The coping assembly 10 is intended to provide a means for capping the wall 12 so as to preclude water from seeping into the top of the wall and also providing a decorative cover for the top of the wall to enhance the appearance of the building.

The coping assembly 10 includes a rigid anchor bar 16 secured by a plurality of fasteners 18 to a wooden nailer 20 extending along the length of the top of the wall. The rigid anchor bar 16, secured to the face of the wall 12 and the nailer 20 extends along the entire length of the face of the wall. In one form of the invention, the anchor bar 16 is comprised of an aluminum extrusion, and the aluminum material is of sufficient thickness that the anchor bar 16 forms a relatively stiff, rigid support structure. The anchor bar is comprised of an elongated body portion 22 having forward and rearward planar vertical surfaces 24 and 26, respectively, the rearward vertical surface 26 being adapted to engage the vertical face 28 defined by the wall and the nailer. The elongated body portion includes a plurality of apertures or slots 30 spaced apart along its length, each aperture 30 being adapted to house a fastener 18. In the illustrated arrangement, the fasteners 18 comprise screws extending through the apertures into the nailer 20 to secure the anchor bar to the nailer.

An upper portion 32 of the vertical plate portion 22 of the anchor bar extends above the top of the nailer 20, and a rib or flange 34 projects rearwardly from the rear surface of the vertical plate portion. The rib or flange has a horizontal lower surface 36 adapted to engage the top of the nailer 20 at the junction of the top of the nailer with its vertical face, the rib or flange 34 providing a means for supporting the anchor bar 16 against downward movement with respect to the wall. In a preferred form of the invention, the rearwardly projecting rib or flange 34 and the vertical plate portion 22 of the anchor bar are integrally joined or unitarily formed such that the rib 34 is rigid with respect to the vertical plate portion 22 of the anchor bar.

The coping assembly 10 also includes a snap-on coping 38 adapted to cover the top of the wall and cooperating with the anchor bar 16 such that a forward portion of the coping 38 is secured to the wall 12. The coping 38 comprises an inverted generally U-shaped channel adapted to extend along the length of the wall and includes a top generally horizontal portion 40 having a forward edge and a rearward edge. A coping face portion 42 extends downwardly from the forward edge of the top 40, and the coping face portion 42 includes a lower edge 44 adapted to engage and to be supported by the lower edge of the anchor bar 16. In the illustrated arrangement, the lower edge 44 of the coping face includes an inwardly and upwardly extending lip adapted to hook under the lower edge of the anchor bar 16. The coping also includes a rear face portion 46 extending downwardly from the rear edge of the coping top 40, the rear face portion 46 being adapted to be spaced from and parallel to the generally vertical rear face 48 of the wall 12 and the nailer 20.

The upper portion 32 of the anchor bar is adapted to rigidly support the forward portion of the coping 38 at the juncture of the top 40 and the downwardly extending coping face 42. This upper portion 32 of the anchor bar includes a forwardly projecting flange 50 having an upper surface 52 adapted to support the forward portion of the top 40 of the coping. The flange 50 of the anchor bar is rigid and accordingly provides a rigid supporting surface for the forward edge of the coping along the entire length of the wall. In the illustrated arrangement the flange 50 has an inclined upper surface complementary to the incline of the top of the coping.

In the illustrated arrangement the anchor bar 16 also includes a lower edge portion adapted to engage the lower edge 44 of the coping face 42 so as to secure the coping 38 in position. The lower edge portion includes a downwardly and forwardly inclined portion 58 and a downwardly extending flange 60 spaced outwardly from the face of the wall. The downwardly extending flange 60 terminating in a lower edge, and the lip of the coping face is adapted to extend upwardly under the lower edge of the flange such that the coping 38 can securely engage the lower edge of the anchor bar 16.

Means are also provided for resiliently supporting the rearward portion of the coping 38 in spaced relation from the top of the nailer 20 and such that the coping is firmly held in place with respect to the wall and the nailer. More specifically, a plurality of cleats 70 are spaced apart along the length of the top of the nailer 20 and are secured in place by fasteners 72 extending downwardly into the wooden nailer. In one form of the invention, each cleat 70 may be one-foot wide and they can be spaced apart along the top of the wall on four foot centers. Each cleat 70 can be comprised of sheet metal and includes a central horizontal portion 74 secured to the top surface of the nailer 20 by fasteners 72. A portion 76 of the central horizontal portion of the cleat extends rearwardly of the rearward edge of the nailer, and a portion 78 of the cleat extends downwardly from the rear edge and generally parallel to the rear face defined by the nailer 20 and the wall 12. The lower edge 80 of the rear portion 78 of the cleat 70 is inclined downwardly and outwardly and is adapted to engage and support a lip 82 of the lower edge of the rear face 46 of the coping 38.

The cleat 70 also includes a forward portion 86 which is inclined upwardly and forwardly and is housed under a retaining lip 88 of the anchor bar 22. The retaining lip 88 projects rearwardly and downwardly with respect of the top of the anchor bar 16 and so as to define a cavity extending along the length of the anchor bar for housing the upwardly inclined forward edge 86 of the cleat 70.

The cleats also include resilient coping support springs 90 supported by the upper surface of a rear portion of the cleat and adapted to support a rear portion of the coping 38 at the juncture of the top 40 of the coping and the rear face 46. The coping support spring 90 provides sufficient upward force on the coping to keep the lower edge 82 of the coping in engagement with the lower edge 80 of the rear portion 78 of the cleat 70.

During installation of the coping assembly 10 embodying the invention to the top of the wall 12, the elongated anchor bar 16 is secured by fasteners 18 to the face of the wall 12 and to the face of the nailer 20 with the lower surface 36 of the rearwardly extending rib 34 supported on the upper surface of the nailer 20. The cleats 70 are then installed, with the forward edge 86 of each cleat first being inserted under the retaining lip 88 of the anchor bar 16, and then securing the cleat 70 in place with the fastener 72. The coping 38 is then placed over the wall and the lip 44 at the lower edge of the coping face 42 is hooked under the lower edge 60 of the anchor bar 16. The rearward potion of the coping 38 is then forced downwardly against the force of the coping supporting spring 90 until the lower edge 82 of the rear face 46 hooks under the lower edge 80 of the rear walls of the cleats 70.

One of the advantages of the invention is that the forward portion of the coping is rigidly supported continuously and along its entire length by the upper edge of the anchor bar.

Another feature of the coping assembly embodying the invention is that the lower portion of the anchor bar 16 precludes wind from getting under the coping 38 and between the coping and the top of the wall and thus prevents high winds from pulling the coping off the wall.

Another of the advantages of the invention is that the coping assembly can be fixed to the face of the top of the wall and provides a uniform decorative face for the wall, while also compensating for variations in the thickness of the wall or inconsistencies in the angle between the top of the wall and he front and rear faces of the wall.

Figure 4:
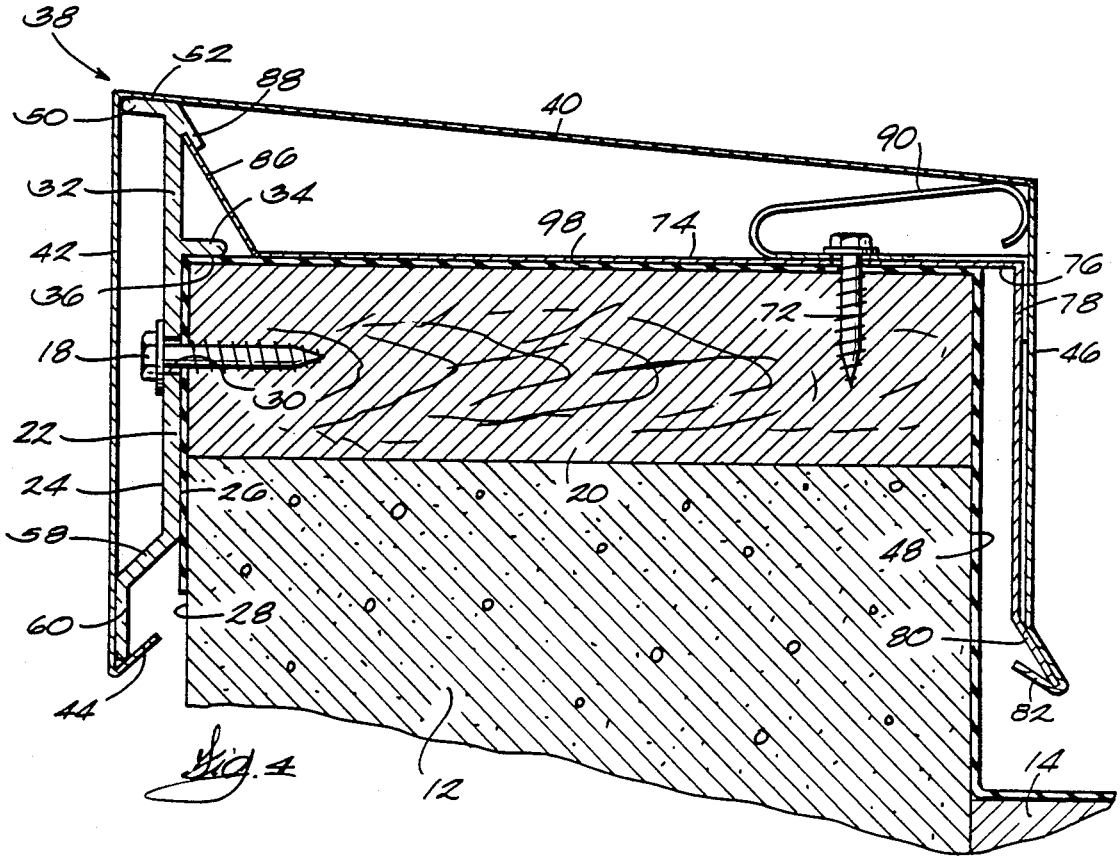
FIG. 4 is a view similar to FIG. 3 and showing the edge of a rubber membrane secured to the top of a wall by the coping assembly embodying the invention.

FIG. 4 illustrates another embodiment of the invention and wherein the coping assembly 10 also functions to secure a rubber membrane 98 in place when an edge of a rubber roof membrane is laid over the top of the wall 12. In the embodiment shown in FIG. 4, the membrane is clamped in place against the top of the nailer by the cleats 70 and the fasteners 72, and the rubber membrane is also clamped against the face of the wall by the anchor bar 16 and the fasteners 18. The coping assembly 10 thus provides a rigid structure for securely fastening the edge of a rubber roof membrane in place and in a manner wherein the membrane 98 can resist even those loads placed on it by high winds.

Various features of the invention are set forth in the following claims.

We claim:

1. A coping assembly for covering the top of a wall adjacent to a roof, the wall including a top surface, a forward face and a rear face, the coping assembly comprising:

an anchor bar adapted to be secured to the forward face of the wall, the anchor bar being an elongated plate adapted to extend along substantially the entire length of the forward face of the wall, and the anchor bar including an elongated upper edge and an elongated lower edge;

a coping having an inverted channel configuration and including a top portion adapted to cover the top surface of the wall, a forward face extending downwardly from the top portion, and a rearward face extending downwardly from the top portion, the forward face of the coping including a lower edge portion engaging the elongated lower edge of the anchor bar, and a forward portion of the top of the coping being supported by the elongated upper edge of the anchor bar.

2. A coping assembly as set forth in claim 1 and further including at least one coping support cleat adapted to be secured by a fastener to the top of the wall, the coping support cleat including a generally horizontal portion adapted to be supported by the top of the wall, the horizontal portion including a forward edge, an upwardly inclined forward portion extending upwardly and forwardly from the forward edge and terminating in an edge, and a downwardly extending rear wall portion extending downwardly from the horizontal portion and adapted to be positioned in facing relation with the rear face of the wall, the downwardly extending rear wall portion having a lower edge.

3. A coping assembly as set forth in claim 2 wherein the cleat further includes spring means for resiliently biasing the rearward face of the coping upwardly such that the lower edge of the rear face of the coping will engage and grip the lower edge of the rear wall of the cleat.

4. A coping assembly as set forth in claim 2 wherein the rearward face of the coping includes a lower edge having means for engaging the lower edge of the rear wall portion of the cleat.

5. A coping assembly as set forth in claim 4 wherein said lower edge of said rearward face of the coping includes a lip adapted to extend under the lower edge of the rear wall portion of the cleat to thereby grip the cleat.

6. A coping assembly as set forth in claim 2 wherein anchor bar upper edge includes a rearwardly projecting lip adapted to house the edge of the upwardly inclined forward portion of the cleat.

7. A coping assembly as set forth in claim 6 wherein the rearwardly projecting lip of the anchor bar projects downwardly and rearwardly from the upper edge of anchor bar and the rearwardly projecting lip extends along the length of the upper edge of the anchor bar.

8. A coping assembly for covering the top surface of a wall adjacent to a roof, the wall including a top surface, a forward face and a rear face, the coping assembly comprising:

an anchor bar adapted to be secured to the forward face of the wall, the anchor bar being an elongated plate adapted to extend along substantially the entire length of the forward face of the wall, and the anchor bar including an elongated upper edge and an elongated lower edge, the anchor bar upper edge including a rearwardly projecting lip;

a coping having an inverted channel configuration and including a top portion adapted to cover the top surface of the wall, a forward face extending downwardly from the top portion, and a rearward face extending downwardly from the top portion, the forward face of the coping including a lower edge portion engaging the lower edge of the anchor bar, and a forward portion of the top of the coping being supported by the elongated upper edge of the anchor bar;

at least one coping support cleat adapted to be secured by a fastener to the top of the wall, the coping support cleat including a generally horizontal portion adapted to be supported by the top of the wall, the horizontal portion including a forward edge, an upwardly inclined forward portion extending upwardly and forwardly from the forward edge and terminating in an edge adapted to be housed by the rearwardly projecting lip of said anchor upper edge, and a downwardly extending rear wall portion extending downwardly from the horizontal portion and adapted to be positioned in facing relation with the rear face of the wall, the downwardly extending rear wall portion having a lower edge.

9. A coping assembly as set forth in claim 8 wherein the rearwardly projecting lip of the anchor bar projects downwardly and rearwardly from the upper edge of the anchor bar and the rearwardly projecting lip extends along the length of the upper edge of the anchor bar.

* * * * *